US012291888B2

(12) United States Patent
Casamento

(10) Patent No.: US 12,291,888 B2
(45) Date of Patent: May 6, 2025

(54) FENCE POST STAY FOR WIRE FENCES

(71) Applicant: TRIGGER ENGINEERING & CONSULTING PTY LTD, Thomastown (AU)

(72) Inventor: Steven Philip Casamento, Thomastown (AU)

(73) Assignee: TRIGGER ENGINEERING & CONSULTING PTY LTD, Thomastown (AU)

( * ) Notice: Subject to any disclaimer, the term of this patent is extended or adjusted under 35 U.S.C. 154(b) by 416 days.

(21) Appl. No.: 17/617,967

(22) PCT Filed: Jun. 11, 2020

(86) PCT No.: PCT/AU2020/050591

§ 371 (c)(1),
(2) Date: Dec. 10, 2021

(87) PCT Pub. No.: WO2020/248015

PCT Pub. Date: Dec. 17, 2020

(65) Prior Publication Data

US 2022/0251872 A1 Aug. 11, 2022

(30) Foreign Application Priority Data

Jun. 11, 2019 (AU) ..... 2019902027

(51) Int. Cl.
*E04H 17/20* (2006.01)
*E04H 17/02* (2006.01)

(52) U.S. Cl.
CPC ..... *E04H 17/23* (2021.01); *E04H 17/02* (2013.01)

(58) Field of Classification Search
CPC ..... E04H 17/02; E04H 17/055; E04H 17/06; E04H 17/08; E04H 17/1473; E04H 17/1488; E04H 17/22; E04H 17/23
See application file for complete search history.

(56) References Cited

U.S. PATENT DOCUMENTS 10,781 A * 4/1854 Coons ..... E04H 17/08 256/35
277,877 A * 5/1883 Brown ..... E04H 17/08 256/36

(Continued)

FOREIGN PATENT DOCUMENTS

DE 1684784 A1 * 2/1970
FR 2858988 A1 * 2/2005 ..... E04H 17/1413

(Continued)

OTHER PUBLICATIONS

The International Search Report and The Written Opinion of the International Searching Authority for corresponding PCT Applicaiton No. PCT/AU2020/050591, dated Jul. 3, 2020, 11 pages.

*Primary Examiner* — Jonathan P Masinick
(74) *Attorney, Agent, or Firm* — Tucker Ellis LLP; Michael G. Craig

(57) ABSTRACT

Some embodiments relate to a fence post stay for supporting a first post in a wire fence having a plurality of wires. The stay may comprise: a first connector and a second connector; and an elongate first member connected to and extending between the first and second connectors. The first connector is engageable with the first post and the second connector is engageable with an adjacent second post, such that a tension force exerted by the plurality of wires on the first post is at least partially directed through the stay to the second post.

18 Claims, 12 Drawing Sheets

(56) References Cited

U.S. PATENT DOCUMENTS 299,770 A * 6/1884 Fishcer ..... E04H 17/08 52/157
451,461 A * 5/1891 Darnell ..... E04H 17/08 52/298
453,148 A * 5/1891 Kiler ..... E04H 17/08 256/65.03
539,411 A * 5/1895 Brown ..... E04H 12/2215 52/166
552,944 A * 1/1896 Whitehead ..... E04H 17/08 256/42
560,364 A * 5/1896 Owens ..... E04H 17/08 52/149
567,557 A * 9/1896 Whitehead ..... E04H 17/08 256/35
619,684 A 2/1899 Emerton et al.
913,502 A * 2/1909 Houdyshell ..... E04H 17/08 52/151
3,655,167 A * 4/1972 Skille ..... E04H 17/08 256/35
3,674,243 A * 7/1972 Brown ..... E04H 17/1447 256/65.05
4,582,300 A * 4/1986 Chappell ..... E04H 17/16 160/374
4,679,772 A * 7/1987 Peterson ..... E04H 17/08 256/35
4,763,879 A 8/1988 Wasicek et al.
4,889,322 A 12/1989 Wagner
4,979,724 A 12/1990 Williams
5,061,109 A 10/1991 Miller
2015/0300558 A1* 10/2015 Bishop ..... F16M 13/02 248/219.4
2017/0159321 A1* 6/2017 Goedecke ..... E04H 17/1448
2017/0167160 A1* 6/2017 Beisser, III ..... E04H 17/266
2018/0238076 A1* 8/2018 Thiem ..... E04H 17/1473

FOREIGN PATENT DOCUMENTS

FR 3041017 B1 * 10/2017 ..... E01F 13/02
KR 200464339 Y1 * 12/2012

* cited by examiner

FENCE POST STAY FOR WIRE FENCES

CROSS-REFERENCE TO RELATED APPLICATIONS

This application is a national phase application of International Application No PCT/AU2020/050591, filed Jun. 11, 2020, which claims priority to Australia Patent Application Serial No. 2019902027, filed Jun. 11, 2019, all of which are incorporated herein by reference.

BACKGROUND

Disclosed embodiments relate generally to wire fence supports. In particular, embodiments relate to fence post stays or end assemblies for wire fences and to wire fences and methods using such stays or end assemblies.

Wire or cable fences are commonly used to demarcate boundaries for properties. Agricultural applications for wire fences include restricting the movement of livestock, and for vineyard trellises.

A wire fence has a plurality of wires supported along their length by a series of posts. Each wire is tensioned to provide an effective barrier. Strainer or end assemblies comprising a strainer post are typically positioned at each end of a wire fence. Strainer assemblies may additionally be used at intermediate posts in longer fences, at gate posts, or wherever the fence changes direction, such as at corners, the crest of a hill, or the bottom of a gully.

The tension forces from the fence wires, forces due to impact from animals, and the weight of accessories such as gates are directed to the strainer assemblies. These forces are capable of pulling the strainer post over or out of the ground, resulting in a loss of tension in the fence wires and consequently an ineffective barrier.

To withstand these forces, existing strainer assemblies typically further comprise a stay to brace the strainer post and to direct the majority of the fence forces into the ground. One end of the stay is embedded in the ground, or is at least attached to a structure contacting the ground. Preparing the correct length of stay, and properly fitting the stay to direct the forces is a time-consuming process requiring diligence and physical exertion, such as digging holes by hand or with the aid of a mechanical auger.

Examples of existing products include off-the-shelf strainer assemblies comprising a stay with a floating footplate, wherein the footplate is in contact with the ground but is not anchored to it. Other example products supply the stay only, which may be retrofitted to existing strainer posts. These off-the-shelf kits often require assembly on site, and/or require tools to do so.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

It is desired to address or ameliorate one or more shortcomings or disadvantages associated with prior wire fence supports and their methods of manufacture, or to at least provide a useful alternative thereto.

SUMMARY

Some embodiments relate to a fence post stay for supporting a first post in a wire fence having a plurality of wires, the stay comprising a first connector and a second connector, and an elongate first member extending between the first and second connectors. The first connector is engageable with the first post, and the second connector is engageable with an adjacent second post, such that a tension force exerted by the plurality of wires on the first post is at least partially directed through the stay to the second post.

The first connector may comprise a first collar enabling the first post to be received therein, and the second connector comprises a second collar enabling the second post to be received therein.

The stay may further comprise a third connector and an elongate second member extending between the first connector and the third connector, wherein the third connector comprises a third collar. The third connector may be engageable with the second post, and wherein the third collar enables the second post to be received therein. Furthermore, the first connector may be engageable with an upper portion of the first post, the second connector is engageable with a lower portion of the second post, and the third connector is engageable with an upper portion of the second post.

In some embodiments, the third connector may instead be engageable with a third post disposed adjacent to the second post, such that the tension force is also at least partially directed through the stay to the third post. Specifically, the first connector may be engageable with an upper portion of the first post, the second connector may be engageable with a lower portion of the second post, and the third connector may be engageable with an upper portion of the third post. The third collar enables the third post to be received therein.

Some embodiments relate to a fence post stay for supporting a first post in a wire fence having a plurality of wires, the stay comprising: a first connector, a second connector, and a third connector; an elongate first member connected to and extending between the first and second connectors; and an elongate second member connected to and extending between the first connector and the third connector; wherein the first connector is engageable with the first post, the second connector is engageable with an adjacent second post, and the third connector is engageable with the second post or an adjacent third post, such that a tension force exerted by the plurality of wires on the first post is at least partially directed through the stay to: (i) the second post; or (ii) the second post and the third post. The first connector may comprise a first collar enabling the first post to be received therein, and the second connector may comprises a second collar enabling the second post to be received therein, and the third connector may comprise a third collar enabling the second post or the third post to be received therein. The first connector may be engageable with an upper portion of the first post, and the second connector may be engageable with a lower portion of the second post. The third connector may be engageable with an upper portion of the second post or an upper portion of the third post.

The aforementioned embodiments of the collars may have an oblong or obround cross-section to make it easier for the stay to be installed at an angle on the posts. For example, the oblong or obround cross-section of the collars may allow a first angle between a longitudinal axis of the post and a longitudinal axis of the collar to measure between approximately 0 degrees and approximately 25 degrees. Furthermore, a second angle between the aforementioned embodiments of the first member and the second member may measure between approximately 30 degrees and approximately 50 degrees, and in some embodiments, the second angle may not substantially exceed 45 degrees.

The aforementioned embodiments of the first and second members may be directly connected. Alternatively, the first and second members may be connected to the first connector. Furthermore, the first and second members may be formed from a continuous length of material, such as hot-dip galvanised steel tubing.

The aforementioned embodiments of the first connector may comprise attachment means for receiving the first member. In some embodiments, the attachment means is a socket.

Some embodiments relate to a wire fence including a plurality of posts and the stay. The collars of the stay are placed in engagement with the fence posts. For example, the first collar is slid onto and optionally secured to the first post, and the second and third collars are both slid onto and optionally secured to the second post. In embodiments where a third post is present, the third collar is instead slid onto and optionally secured to the third post. In this way, a force exerted on the first post is transferred to the second and/or third posts through the stay.

Some embodiments relate to a method of installing or supporting a wire fence having a plurality of posts, including installing the aforementioned embodiments of the stay onto the first and second posts. Some embodiments relate to a method of installing or supporting a wire fence having a plurality of posts, including installing the aforementioned embodiments of the stay, wherein the method comprises (i) securing the first connector to the first post, securing the second connector to the second post, and securing the third connector to the second or third posts; and (ii) connecting the fence wires to the posts. The fence according to the aforementioned methods may be an existing fence, or a fence which is being newly installed.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments are described in further detail below, by way of example, with reference to the accompanying drawings, in which.

DETAILED DESCRIPTION

Figure 1:
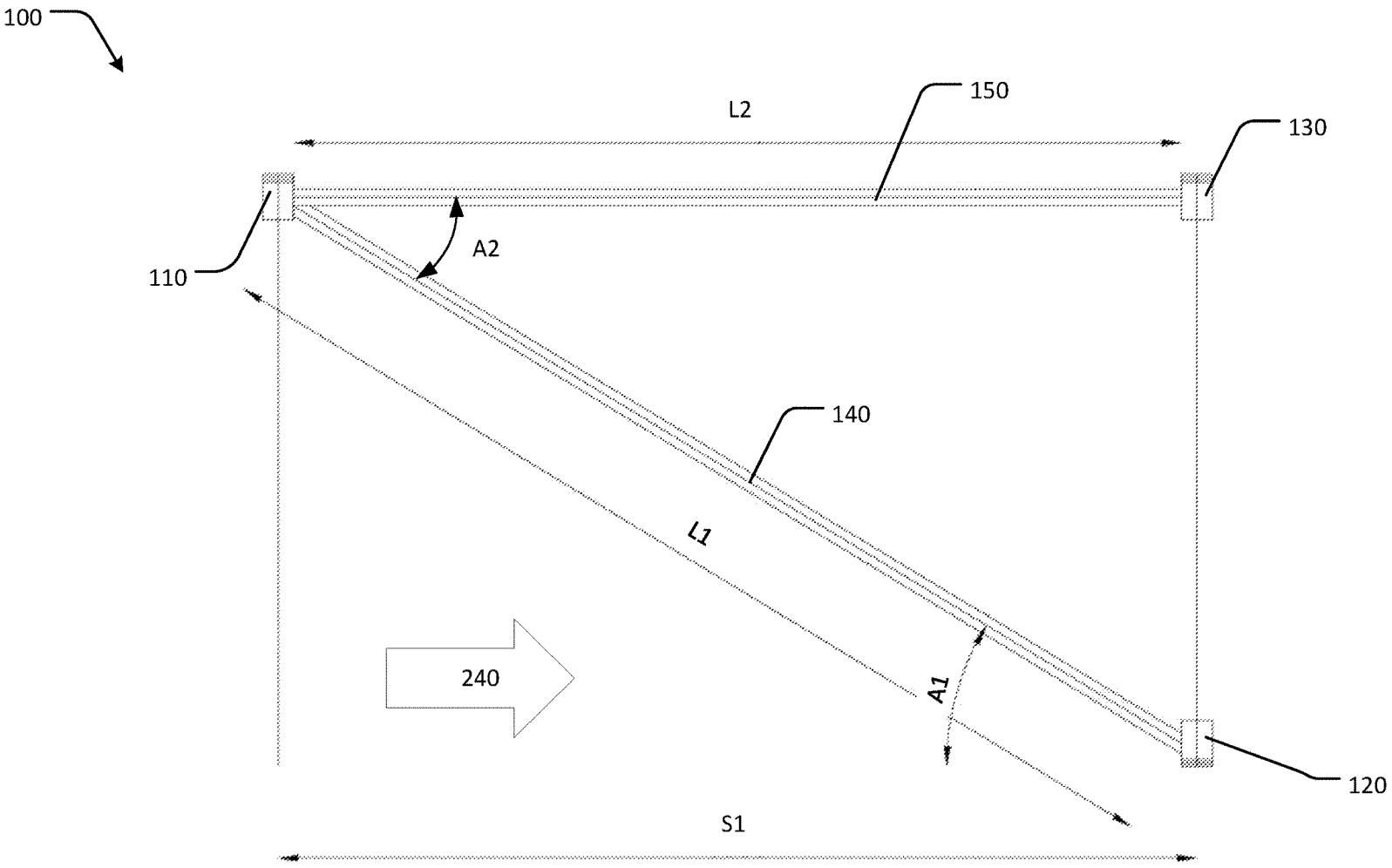
FIG. 1 is a front view of an embodiment of a fence post stay for supporting a first post in a wire fence.

Disclosed embodiments relate generally to wire fence supports. In particular, embodiments relate to fence post stays or end assemblies for wire fences and to wire fences and methods using such stays or end assemblies. Corresponding components of different embodiments are marked with the same reference numeral for clarity reasons.

With reference initially to the FIGS. 1 to 7B, a fence post stay 100 for supporting a first post 210 in a wire fence having a plurality of wires is shown. Embodiments of the stay 100 comprise a first connector 110 and a second connector 120, and an elongate first member 140 extending between the first and second connectors 110, 120. The first connector 110 is engageable with the first post 210 and the second connector 120 is engageable with an adjacent second post 220, such that a tension force 240 exerted by the plurality of wires on the first post 210 is at least partially directed through the stay 100 to the second post 220 (see FIGS. 6 and 7A). The wire fence has a plurality of posts along its length, wherein the first post is the endmost post in the fence, and the second post may be the next post along. Herein, reference to an "adjacent" post refers to the next post along in the fence, wherein successive posts are spaced apart from each other by a distance S1 (FIG. 1).

Embodiments of the stay 100 are envisaged to be part of strainer assemblies used to support wire fences, wherein the first post 210 is a strainer post. However, it is further envisaged that the stay 100 can be used to support other posts where bracing of posts is desired. The posts described herein may be posts for fences, gates, viticulture or vineyard trellises, or generally posts subject to wire tension forces 240 in applications where star pickets and the like may be used. Each post described herein has a longitudinal axis.

Preferably, the first connector 110 comprises a first collar 112 enabling the first post 210 to be received therein, and the second connector 120 comprises a second collar 122 enabling the second post 220 to be received therein. In some embodiments, the stay 100 further comprises a third connector 130 and an elongate second member 150 extending between the first connector 110 and the third connector 130, wherein the third connector 130 comprises a third collar 132. The collars 112, 122, 132 are preferably tubular, with a longitudinal axis that is generally parallel to the longitudinal axis of the posts 210, 220 when the stay 100 is installed on the posts 210, 220.

Figure 6:
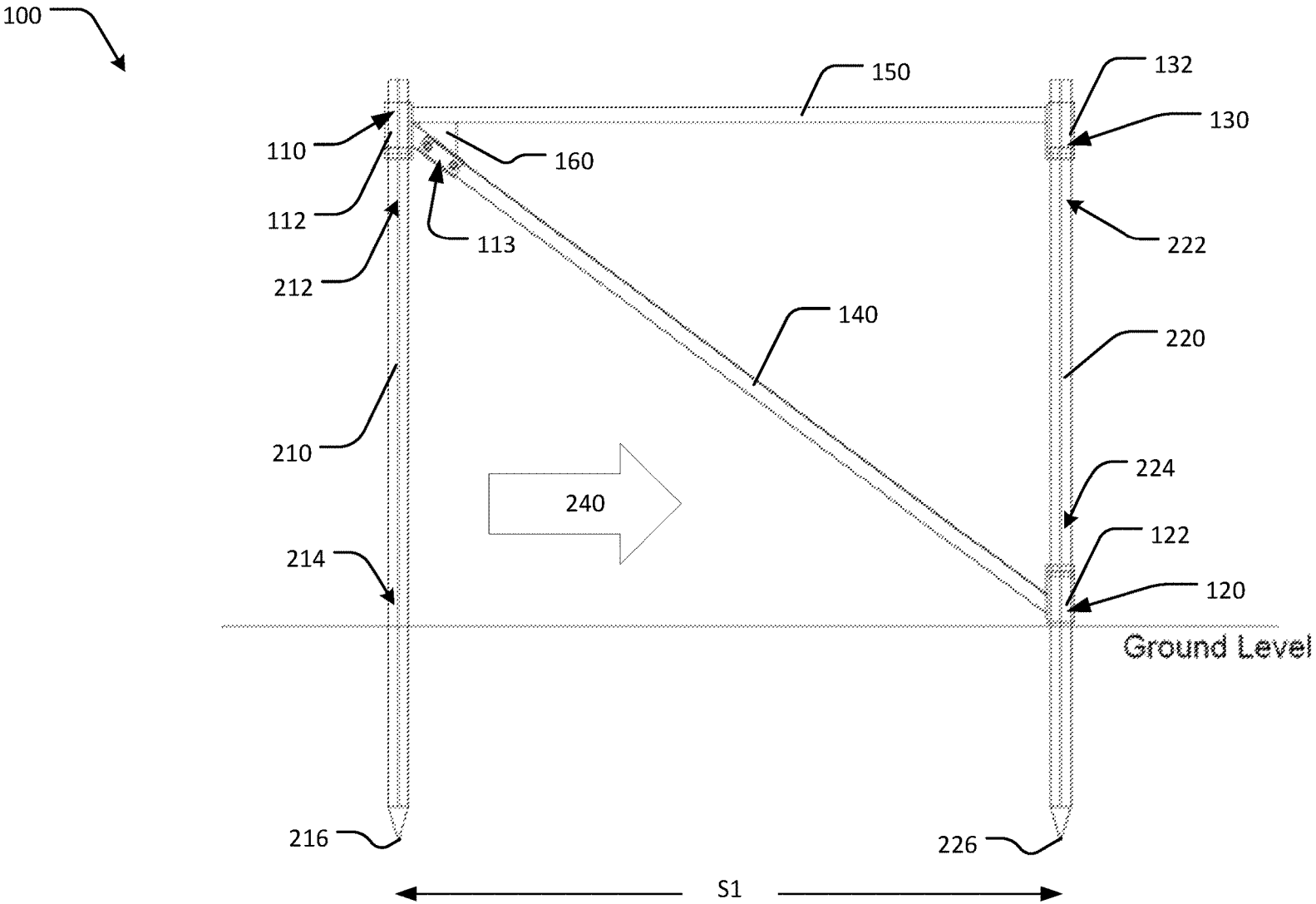
FIG. 6 is a front view of the fence post stay of FIG. 2A supporting a first post in a wire fence on horizontal ground.
Figure 7A:
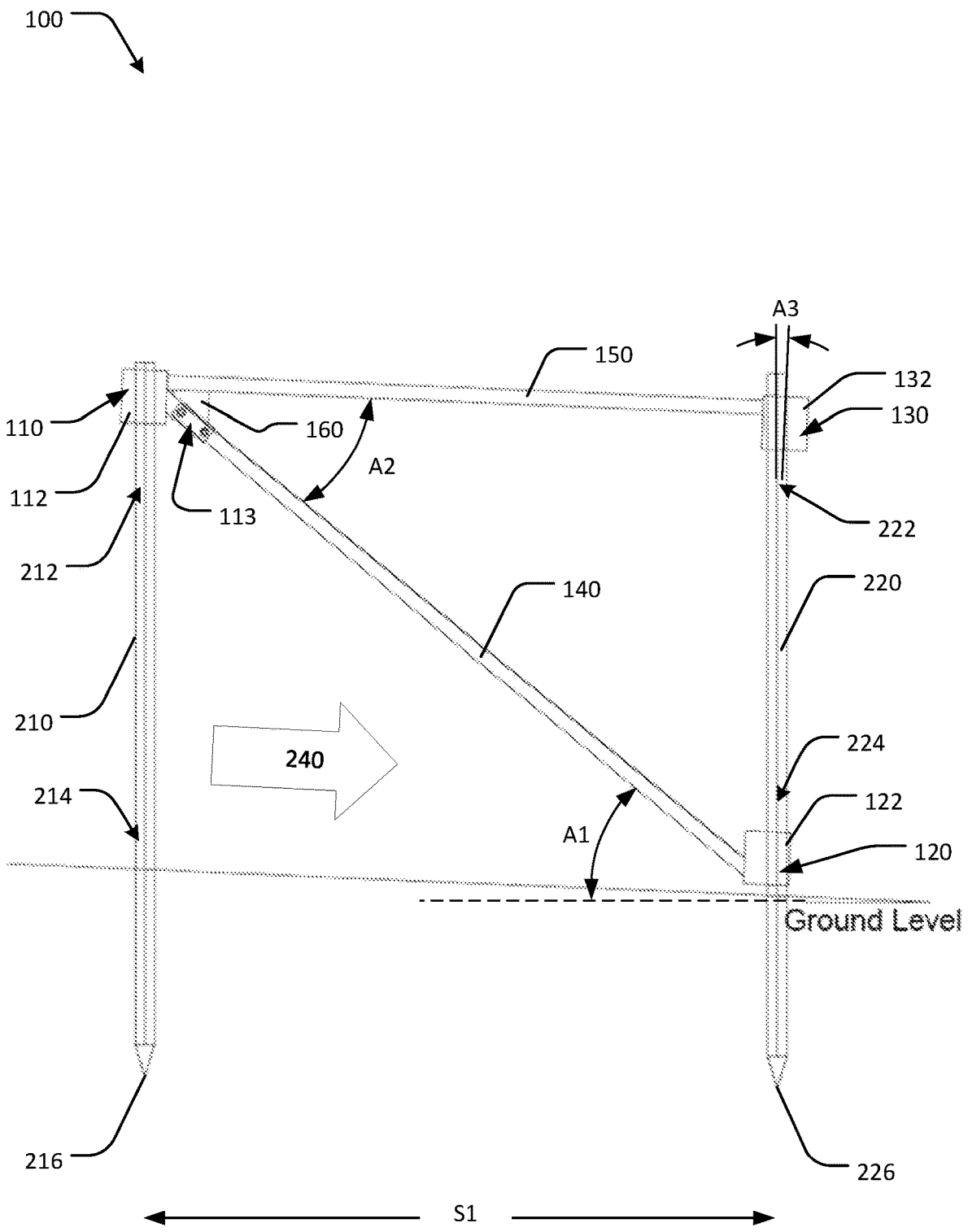
FIG. 7A is a front view of a further embodiment of the fence post stay supporting a first post in a wire fence on slightly inclined ground.
Figure 7B:
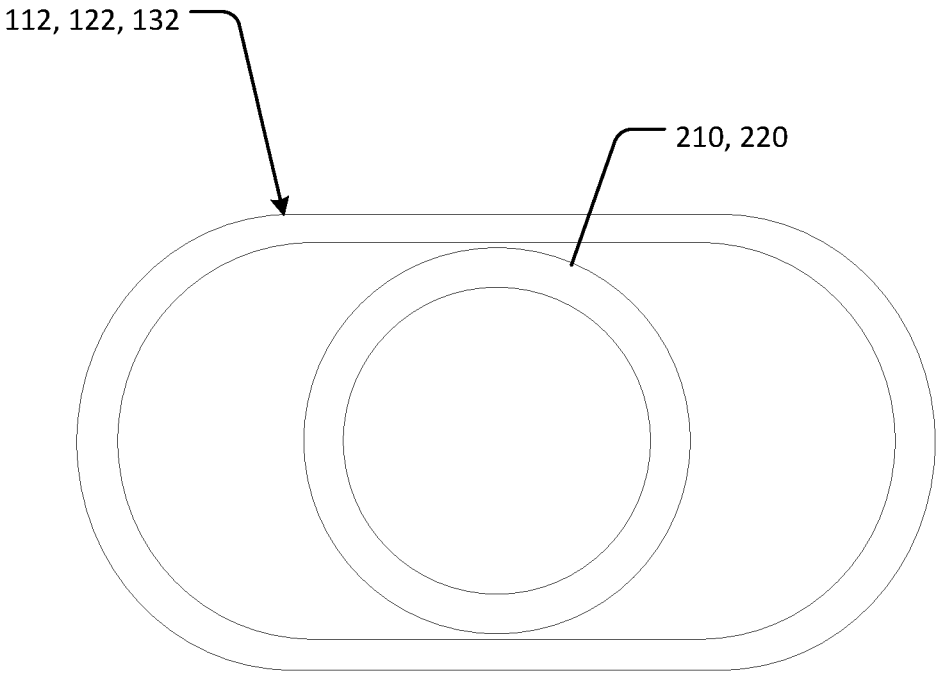
FIG. 7B is a top view of a collar having an obround cross section, to be used with some embodiments of the fence post stay.

In some embodiments, the third connector 130 is engageable with the second post 220, and the third collar 132 enables the second post 220 to be received therein (see FIGS. 6, 7A, and 7B). Furthermore, the first and second members 140, 150 may be connected to the first connector 110. The collars 112, 122, 132 have an inner diameter suitable to receive one of the first and second posts 210, 220. The posts 210, 220 may be, for example, a round steel post. In some embodiments, the posts 210, 220 may be a standard star picket. A standard star picket may have an outer diameter of approximately 50 mm to 60 mm. Star pickets are available in various gauges and sizes, with some heavy duty "maxi" pickets measuring up to 80 mm in diameter. Where a post is used instead of a star picket, the post 210, 220 may have an outer diameter also up to 80 mm. In some embodiments s, the inner diameters of the first, second, and third collars 112, 122, 132 are sized to fit the posts 210, 220 with minimal clearance between the insides of the collars 112, 122, 132 and the outsides of the post 210, 220, for example as shown in FIG. 7B.

Figure 3:
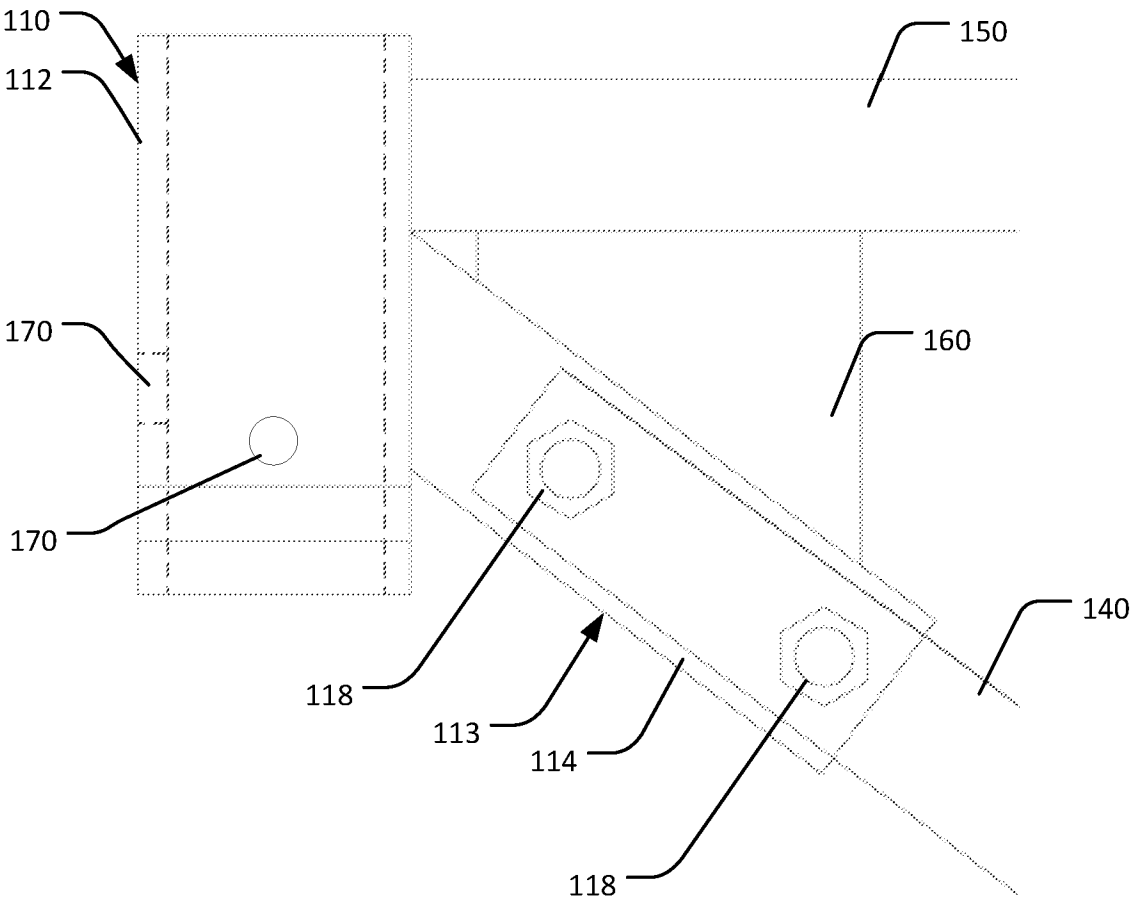
FIG. 3 is a detailed view of a first connection area of the fence post stay of FIG. 2A.
Figure 4:
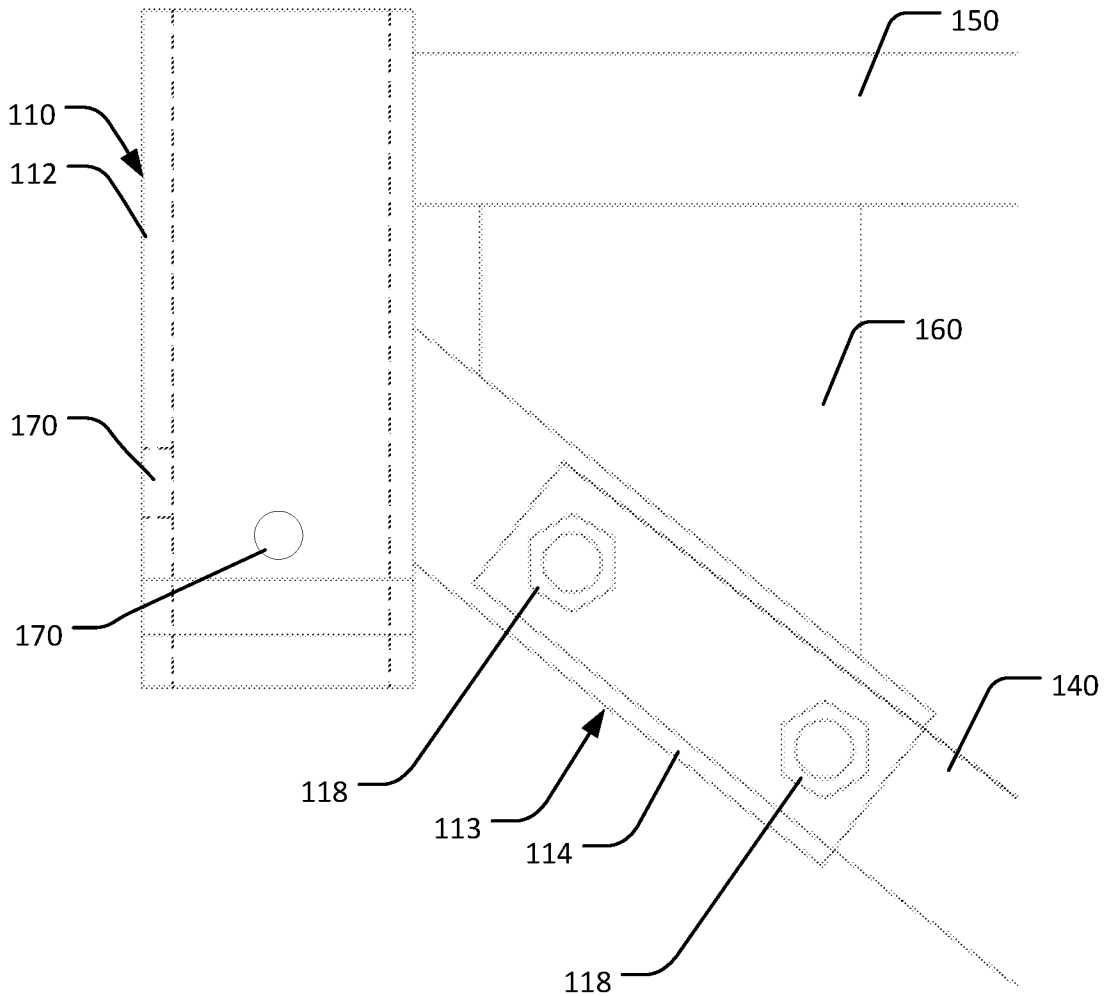
FIG. 4 is a detailed view of a further embodiment of a first connection area of the fence post stay.
Figure 5:
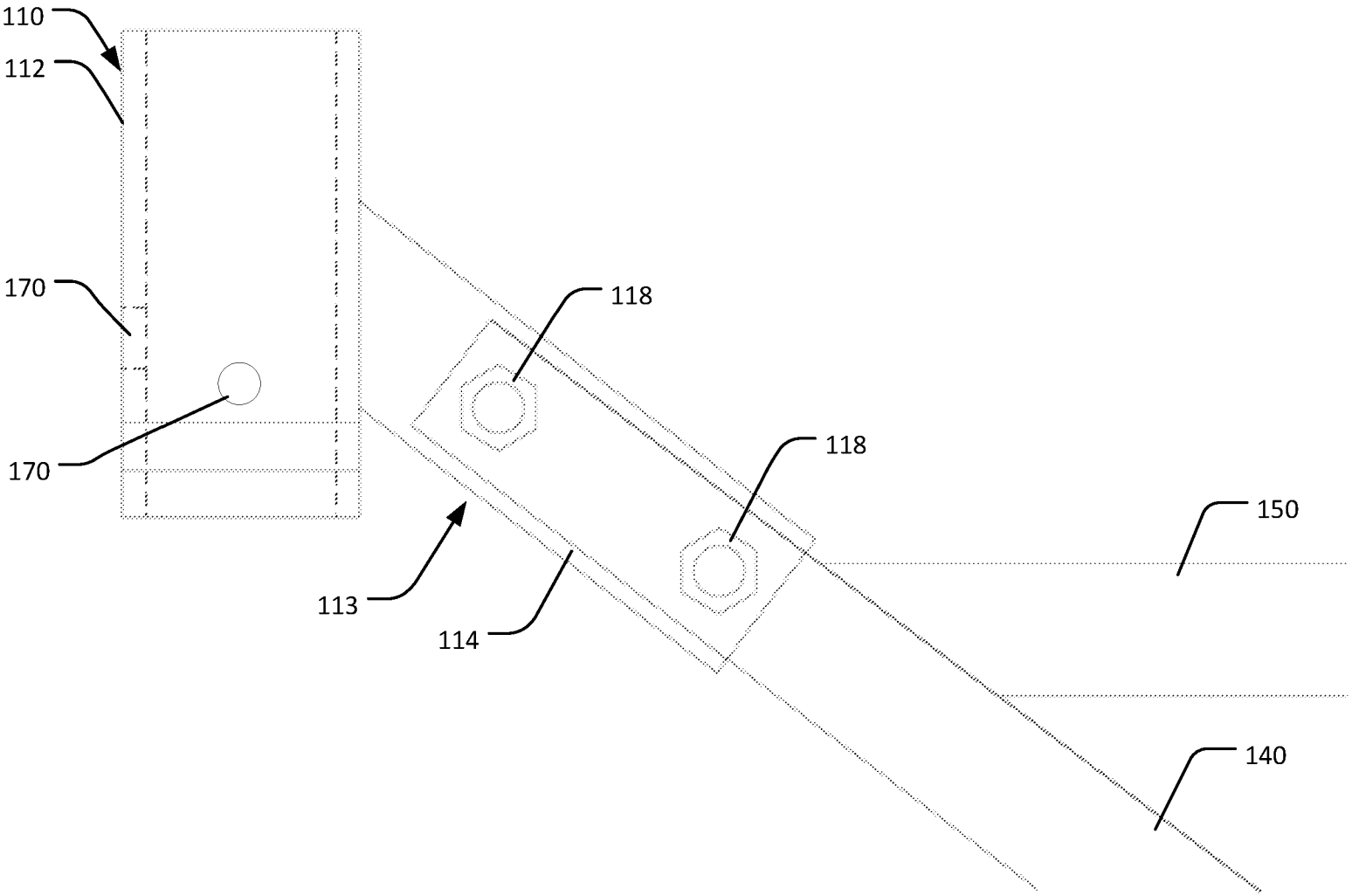
FIG. 5 is a detailed view of a further embodiment of the fence post stay.

Advantageously, the collars 112, 122, 132 allow the stay 100 to be slid onto the posts 210, 220, wherein the longitudinal axis of the collar is at least substantially parallel with the longitudinal axis of the post received therein. This removes the need for welding or mechanical fasteners such as screws, rivets, or bolts to attach the stay 100 to the posts 210, 220, although in some embodiments this may be desired to further secure the stay 100 to the posts 210, 220. In some embodiments, such as shown in FIGS. 3-5, the collars 112, 122, 132 define at least one pre-drilled hole 170 to receive a screw, rivet, or bolt to secure the collar 112, 122, 132 (and the stay 100) to the posts 210, 220. The fence wires or mesh may be attached to the collar 112, 122, 132 by threading a wire through one of the pre-drilled holes 170 and looping the wire around the fence wire or mesh. Traditionally, the cost of labour is one of the largest expenses in installing fence stays or end assemblies. The sliding arrangement enabled by the collars 112, 122, 132 means that the stay 100 can be easily and quickly installed, removed, and replaced if required, thereby reducing installation/maintenance time and the associated labour cost.

Referring now to FIG. 1, an embodiments of the stay 100 is shown comprising the first and second members 140, 150, wherein both the first and second members 140, 150 are connected to the first connector 110. The stay 100 further comprises the second connector 120 at the end of the first member 140 remote from the first connector 110, and the third connector 130 at the end of the second member 150 remote from the first connector 110.

In said embodiments, the longitudinal axis of the first member 140 is a straight line between the first connector 110 and the second connector 120. Similarly, the longitudinal axis of the second member 150 is a straight line between the first connector 110 and the third connector 130. When the stay 100 is installed on the posts 210, 220, the longitudinal axis of the first member 140 is inclined from the horizontal by an incline angle, denoted A1. An interior angle measured between the longitudinal axes of the first and second members 140, 150 is denoted as A2. The lengths L1 and L2 of the first and second members 140, 150 may vary depending on the angles A1 and A2 and the spacing between posts S1. As shown in FIG. 1, the lengths L1 and L2 set the relative spacing of the connectors 110, 120, 130, which in turn sets the spacing between posts S1.

The first member 140 and the second member 150 are attached to each other and to the first connector 110 as shown. Fixedly coupling the members 140, 150 and the connectors 110, 120, 130 together, for example by welding, provides a stable and secure connection therebetween and thus assists the stay to withstand the tension force 240 exerted by the wires (see FIG. 6).

FIGS. 2A to 5 shows a variation of the stay of FIG. 1, wherein the first connector 110 comprises an attachment means 113 for receiving the first member 140. The attachment means 113 may comprise a socket, a plug, and/or a bolted connection, for example. In FIGS. 2A to 5, the first connector 110 is shown comprising a socket 114 suitably sized to receive the first member 140. An optional gusset 160 connects the second member 150 to the socket 114 to provide additional support to the connection with the first member 140. The first member 140 may comprise two holes 116 to receive bolts 118 to secure the first member 140 to corresponding bolt holes defined in the socket 114. The bolts 118 are secured by nuts, which may be tightened "finger tight" onto the bolts before further tightening using a spanner or torque wrench, for example. The stay 100 can thus be assembled by hand or with standard tools. FIG. 2B is a disassembled view of the stay of FIG. 2A. Embodiments of the first and second members 140, 150 may be standard size round tubes with inner diameters measuring between 25 mm and 32 mm, and outer diameters measuring between 33.7 mm and 42.3 mm. For heavy duty applications such as where a larger fence tension force 240 is present, tubes having a larger nominal bore (N.B.) may be used for the stay 100. For example, 50 mm N.B. tube (60.3 mm outer diameter) or 40 mm N.B (48.3 mm outer diameter) may be used.

In some embodiments, the second and/or third connectors 120, 130 also comprise the attachment means 113. Embodiments of the stay 100 comprising the first, second, and third connectors 110, 120, 130 with the attachment means 113 have the advantage of the individual connectors 110, 120, 130 and members 140, 150 being separable and therefore replaceable. This may also have advantages in providing a modular system wherein various embodiments of the connectors 110, 120, 130 and first and second members 140, 150 can be sized and selected according to the requirements on site. This also may lead to cheaper transportation and manufacturing costs as the components of the stay 100 can be manufactured separately and transported in a "flat pack", compact arrangement.

FIG. 3 shows a detailed view of an embodiment of the first connector area comprising both the first and second members 140, 150 connected to the first connector 110, the gusset or stiffening plate 160 adjoining the first and second members 140, 150, and the socket 114. The gusset 160 provides additional strength, rigidity, and/or stiffness in the area where the first and second members 140, 150 connect to the first connector 110.

FIG. 4 shows an alternative arrangement of the first connector area to FIG. 3 wherein the first and second members 140, 150 are connected to the first connector 110 but are slightly more spaced apart than in the embodiment of FIG. 3.

Figure 2A:
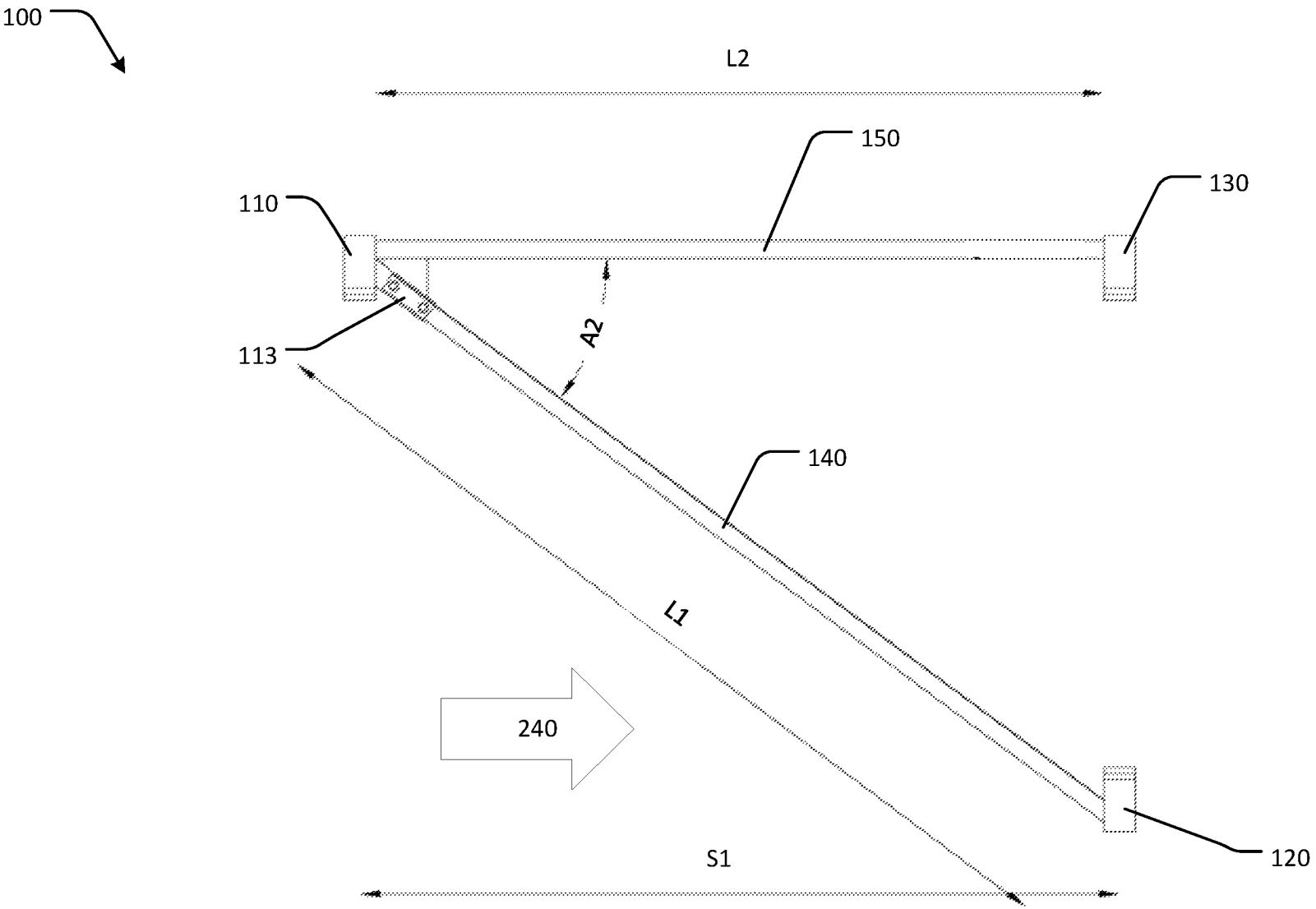
FIG. 2A is a front view of a further embodiment of the fence post stay of FIG. 1.
Figure 2B:
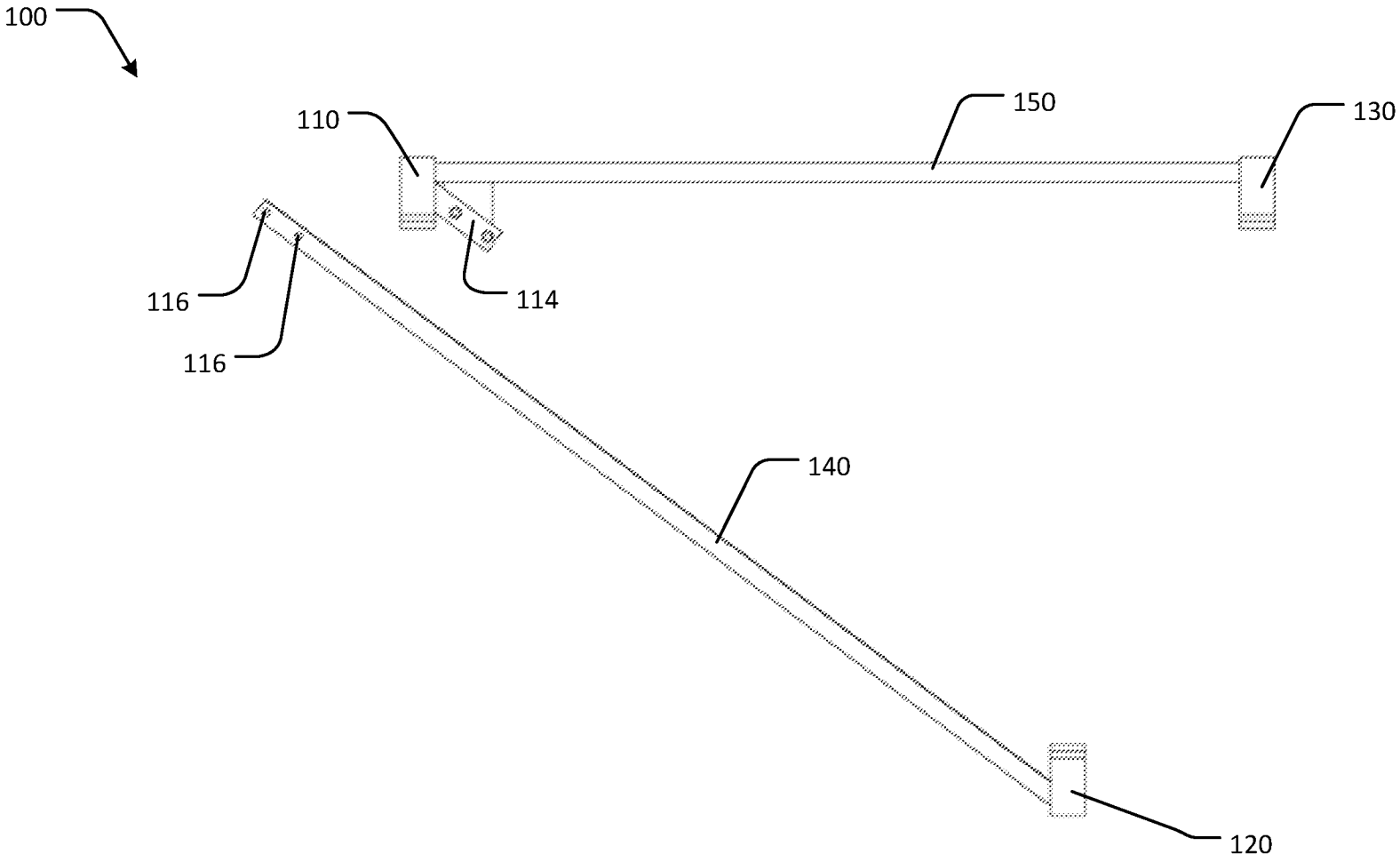
FIG. 2B is an exploded view of the fence post stay of FIG. 2A.

FIG. 5 shows an embodiment of the first connector area wherein the first and second members 140, 150 are directly connected. Specifically, the second member 150 is directly connected to the first member 140 which is received by the socket 114 of the first connector 110. This direct connection may occur by welding, or by a hinge or pivot connection, for example. The hinge or pivot connection may enable the stay to be folded (i.e. reducing interior angle A2 between the first and second members 140, 150) into a more compact form than in its installed form, as opposed to disassembling the first and second members 140, 150 as shown in FIG. 2B. Said folding or disassembly may assist embodiments of the stay 100 to fit on a standard pallet during storage and transport. The hinge or pivot connection may allow variation of the angle A2 between the first and second members 140, 150, for example to accommodate changes at the stay installation site.

In some embodiment of the stay 100, the first connector 110 is engageable with an upper portion 212 of the first post 210, the second connector 120 is engageable with a lower portion 224 of the second post 220, and the third connector 130 is engageable with an upper portion 222 of the second post 220.

FIGS. 6 and 7A show such an arrangement, known as an "angle stay" arrangement, wherein the first collar 112 engages with an upper portion 212 of the first post 210, the second collar 122 engages with a lower portion 224 of the second post 220, and the third collar 132 engages with an upper portion 222 of the second post 220. The first and second posts 200, 210 are set apart by a distance, S1, as measured horizontally between the longitudinal axes of the posts 200, 210. The spacing S1 may range between 1 metre and 3 metres. The other pickets or posts along the length of the fence may be spaced at intervals of 5 metres, for example.

The angle stay arrangement is suitable for firm soil and high tension straining. Existing angle stay arrangements feature the stay supporting the strainer post while the other end of the stay is inserted into the ground (or connect to a stay block affixed to the ground) to direct the tension forces thereto. Supporting a fence post using an embodiment of the stay 100 removes the need to dig holes or pour concrete foundations.

The embodiments of the stay 100 may also be installed in a "box assembly" arrangement, wherein the first collar 112 engages with an upper portion 222 of the second post 220, the second collar 122 engages with a lower portion 214 of the first post 210, and the third collar 132 engages with an upper portion 212 of the first post 210. The box assembly arrangement is suitable for soft ground and high strains. While embodiments of the stay 100 disclosed herein are described with respect to installation in an angle stay arrangement, it should be understood that box stay arrangements may also be possible depending on the installation site conditions.

The upper portion 212, 222 of each post 210, 220 is the portion of the post at and adjacent to the top of the post. Connecting the stay 100 to the upper portion 212, 222 of each post 210, 220 supports the portion of each post likely to deflect the most as a result of the tension force 240.

The lower portion 214, 224 of each post is the portion of the post 210, 220 just above ground level when the post is installed. In regards to the second collar 122 engaging with the lower portion 224 of the second post 220, it is desirable to direct the tension force 240 as close to the ground as possible. Doing so reduces the bending moment and torque experienced by the second post 220 as a result of the tension force 240, and allows a larger proportion of the tension force 240 to be directed to the second post 220, compared to a hypothetical scenario where the tension force 240 is directed to the middle of the post 220, for example.

When the stay is installed on the first and second posts 210, 220, it is also envisaged that the longitudinal axis of the second member 150 is aligned to be at least substantially parallel to the direction of the tension force 240. Consequently, embodiments of the stay 100 preferably comprise an angle A2 that is approximately between 30 degrees and 50 degrees. It is preferable that angle A2 does not substantially exceed 45 degrees. This is to direct a substantial proportion of the tension force 240 through the first member 140 to the lower portion 224 of the second post 220.

The installation method or process of the stay 100 is generally envisaged to be as follows, although it may vary slightly depending on the embodiment of the stay 100 chosen. First, the first and second posts 210, 220 are driven into the ground at a desired spacing S1. The lengths L1 and L2 of the members 140, 150 set the collars 112, 122, 132 at the spacing S1. The collars 112, 122, 132 are positioned over and slid down the posts 210, 220 until the second collar 122 is in contact with the lower portion 224 of the second post 220 and the first and third collars 112, 132 are in contact with the upper portions 212, 222 of the posts 210, 220. This creates triangulation between the first and second posts 210, 220, which improves the rigidity of the structure. The collars 112, 122, 132 may be secured to the posts 210, 220, for example by attaching a fastener through pre-drilled holes 170 in the collars 112, 122, 132. The fastener may be one or a combination of screws, rivets, bolts, or wire. The fence wires may then be run through and/or around the posts 210, 220, secured to the posts 210, 220, and tensioned with an appropriate force 240.

It is noted that the tension force 240 is capable of pulling the posts over. By way of example, high tensile wire approximately 2.8 mm in diameter can have a recommended tension of 2.0 kN, with a breaking strain of 8.0 kN. Narrower wire, such as 1.57 mm diameter barbed wire, can have a recommended tension of 1.3 kN with a breaking strain of 3.0 kN.

Inclined ground, and changes in ground incline (undulating terrain), may exacerbate the effects of this tension force 240. At the top of hills, the tension forces 240 from the wires can push a post deeper into the ground, while at the bottom of gullies the tension forces 240 can pull a post out of the ground. It is envisaged that connecting the stay 100 to a fixed structure (such as the second post 220) provides advantages when the stay 100 is used at the bottom of gullies, in particular helping the posts 210, 220 to resist being pulled out of the ground by the tension 240 in the wires.

For inclined ground, posts 210, 220 may be installed perpendicular to the ground or installed vertically i.e. not perpendicular to the ground. FIG. 7A shows an arrangement where a further embodiment of the stay 100 as shown in FIGS. 2 and 3 is supporting vertically-installed posts. The inclination of the ground means that the upper portions 212, 222 and the lower portions 214, 224 of the first and second posts 210, 220 are at different heights relative to each other.

In order to support the first post 210 by connecting the upper portion 212 of the first post 210 to the lower portion 224 of the second post 220, and to substantially align the second member 150 parallel to the direction of the tension force 240, it may be necessary to change the incline angle A1 and interior angle A2. Furthermore, if it is desired to maintain the same horizontal post spacing S1 on the incline as on horizontal ground, the lengths L1 and L2 of the first and second members 140, 150 may change. By way of example, the lengths L1 and L2 of the first and second members 140, 150 are typically between 1 metre and 2.2 metres when the stay 100 is used to support fence posts installed on horizontal ground.

Figure 8:
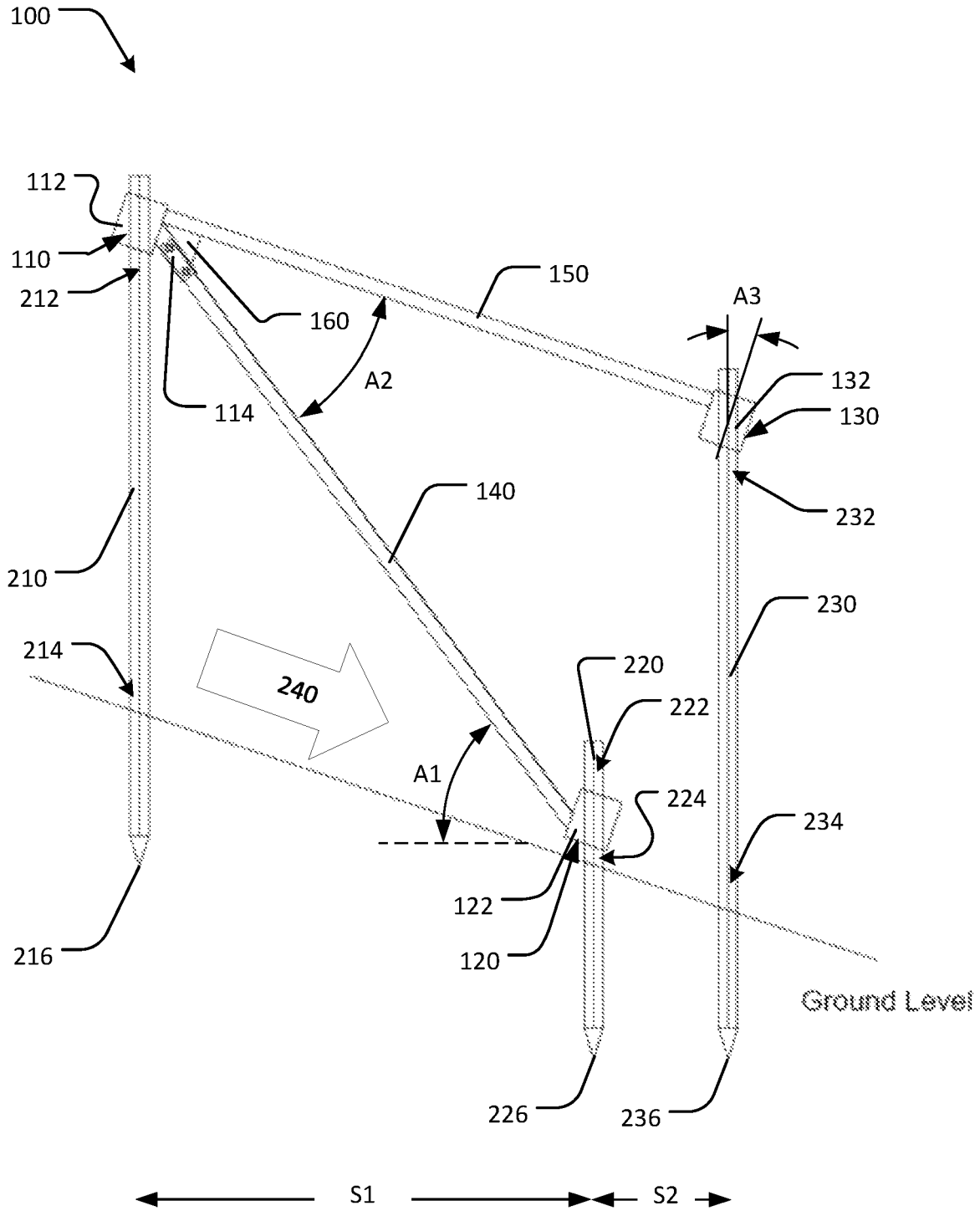
FIG. 8 is a front view of a further embodiment of the fence post stay supporting a first post in a wire fence on steeply inclined ground.

It is envisaged that on shallower inclines, the requirement to change A1, A2, L1, and/or L2 may be mitigated by providing embodiments of the first, second, and third collars 112, 122, 132 with increased clearance between the inside of each collar and the outside of their respective post 210, 220. This allows some freedom in positioning the stay 100 onto the posts 210, 220; for example, the stay 100 may be positioned with a slight tilt as shown in FIGS. 7A and 8. The tilt may be quantified by an angle A3, wherein A3 measures the angle between the longitudinal axis of the post and the longitudinal axis of the collar. In some embodiments, the value of A3 is between approximately 0 degrees and approximately 25 degrees. On steeper inclines, such as shown in FIG. 8, some adjustment of A1, A2, L1, and/or L2 may be necessary.

In some embodiments, the collars 112, 122, 132 have an oblong or obround cross-section to provide the aforementioned increased clearance between the inside of each collar and the outside of their respective post. Embodiments of the collars 112, 122, 132 with the oblong or obround cross-section may be sized to accommodate the maximum angle A3 of around 25 degrees. The oblong or obround cross-section is illustrated in FIG. 7B. In another embodiment, the collars 112, 122, 132 may comprise a pivoted connection to the first and second members 210, 220 to accommodate variations in ground inclination.

Referring now to FIG. 8, an embodiment of the stay 100 is shown wherein the stay 100 is installed to support fence posts on a steeper incline than the ground of FIGS. 6 and 7A. In particular, a third post 230 has been installed in the ground, adjacent to the second post 220 and set apart from the second post 220 by a horizontal distance S2.

As with the embodiments previous described herein, the stay 100 shown in FIG. 8 comprises the first and second members 140, 150, and the first, second, and third connectors 110, 120, 130. While the first and second connectors 110, 120 are engageable with the upper portion 212 of the first post 210 and the lower portion 224 of the second post 220 in the manner previously disclosed, in this embodiment the third connector 130 is engageable with the third post 230, such that the tension force 240 is also at least partially directed through the stay 100 to the third post 230. In particular, the third connector 130 is engageable with an upper portion 232 of the third post 230. The first, second, and third connectors 110, 120, 130 may be the collars 112, 122, 132, and have the oblong or obround cross-section.

Figure 9:
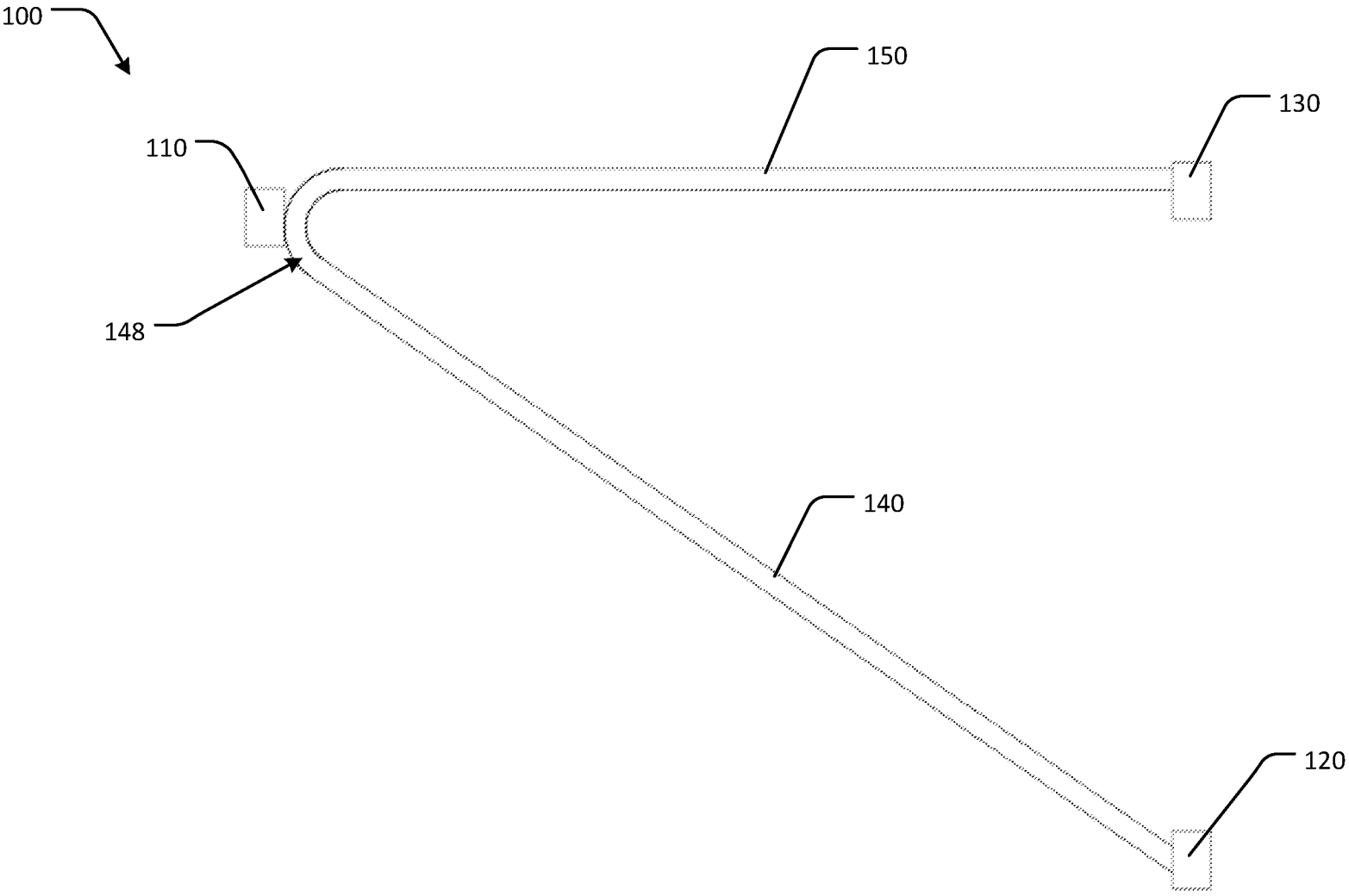
FIG. 9 is a front view of a further embodiment of the fence post stay of FIG. 1.

FIG. 9 shows a further embodiment of the stay 100, wherein the first and second members 140, 150 are formed from a continuous length of material. The first and second members 140, 150 are defined by bending a length of the material to form a bend 148, wherein the first connector 110 is attached to the bend 148.

Figure 10:
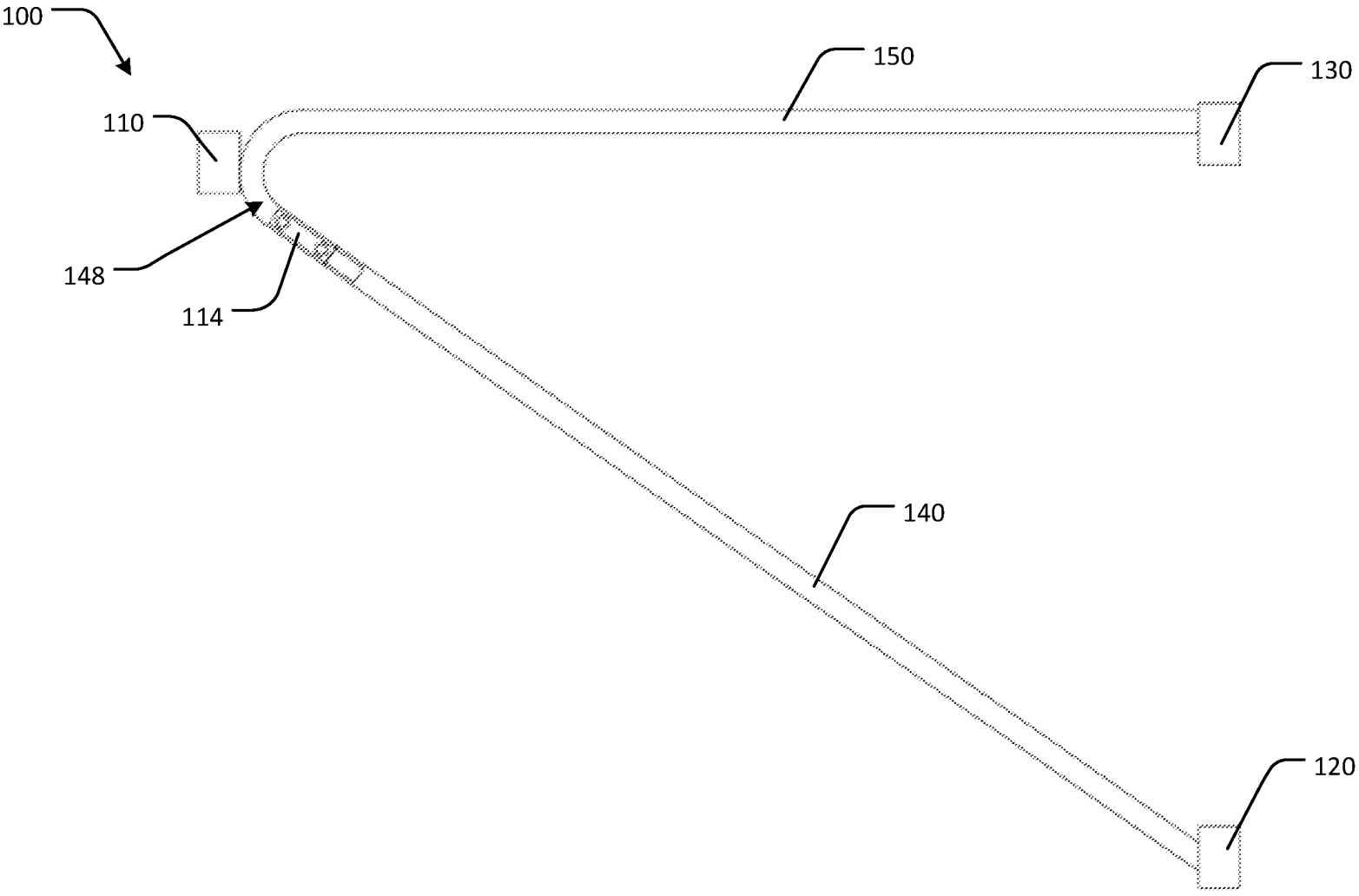
FIG. 10 is a front view of a further embodiment of the fence post stay of FIG. 1.

The embodiment of the stay 100 of FIG. 9 may further comprise the attachment means 113, such as the socket 114, as shown in FIG. 10.

The material for the first and second members 140, 150 may be a metal, or timber. Metal such as aluminium or steel is preferable for fire resistance and termite resistance, and may be finished to resist corrosion by galvanising or painting, for example. Preferably, the material is steel tube or steel pipe that has been hot-dipped galvanised to resist corrosion.

The collars 112, 122, 132 may be made from metal, and preferably from the same metal as the first and second members 140, 150 for welding.

Embodiments of the first, second, and third posts 210, 220, 230 may each comprise a pointed end 216, 226, 236 to enable the posts 210, 220, 230 to be driven deep into the ground, without the need for holes to be dug and backfilled. This removes the need to pour concrete foundations, allowing the posts 210, 220, 230 to be installed far more quickly, and without the need for labour intensive work and additional equipment. Installation time for each post 210, 220, 230 may be a matter of minutes, for example. Lightweight posts or pickets made from metal may be used. The speed of installation and removal lends the stay 100 to be used for temporary fences which are intended to be taken down at a later date, for example on mixed-use allotments or farmland. The stay 100 may also be used for permanent fences. In some embodiments, the posts 210, 220, 230 have an outer diameter in the range of approximately 20 mm to 80 mm. For example, the posts 210, 220, 230 may be a pipe with a 40 mm nominal bore (N.B.) and an outer diameter of 48.3 mm. The posts 210, 220, 230 may be a pipe with a 65 mm nominal bore (N.B.) and an outer diameter of 76 mm. In some embodiments, the posts 210, 220, 230 have an outer diameter of approximately 32 mm. Post lengths may vary according to the desired application, as fence height and the tension force 240 affects the depth that the posts 210, 220, 230 must be driven into the ground. For example, vineyard trellises are typically around 1.8 metres above ground level. Consequently, depending on the desired application, the length of the posts 210, 220, 230 may range between 1.5 metres in length and 3 metres in length.

Currently, heavy machinery and equipment is required to drive heavy timber, metal or concrete posts into the ground. Embodiments of the stay 100 do not require such heavy machinery to be installed over fence posts. Furthermore, when used together with the embodiments of the stay 100 as disclosed herein, a wire fence may be tensioned and supported without the need for heavy machinery. This has advantages in applications where access is restricted, or areas are inaccessible to heavy equipment, or where heavy machinery would damage existing site conditions, such as in environmentally sensitive areas or areas requiring re-vegetation work.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A fence post stay for supporting a first post in a wire fence having a plurality of wires, the stay comprising:

a first tubular collar, a second tubular collar, and a third tubular collar;

an elongate first member connected to and extending between the first and second tubular collars, the first tubular collar comprising an attachment extension for receiving the first member, wherein the attachment extension is fixedly coupled to the first tubular collar and extends away therefrom, wherein the first member is separably coupled to the attachment extension at a first attachment location spaced away from the first tubular collar, and wherein the first member and the second tubular collar are fixedly coupled; and an elongate second member connected to and extending between the first tubular collar and the third tubular collar, wherein the second member and the third tubular collar are fixedly coupled;

wherein the first tubular collar is sized and shaped to operably enclose around the first post, the second tubular collar is sized and shaped to operably enclose around an adjacent second post, and the third tubular collar is sized and shaped to operably enclose around the second post or an adjacent third post, such that a tension force exerted by the plurality of wires on the first post is at least partially directed through the stay to: (i) the second post; or (ii) the second post and the third post.

2. The stay of claim 1, wherein the first and second members are directly connected to each other.

3. The stay of claim 1, wherein the first and second members are directly connected to the first tubular collar.

4. The stay of claim 1, wherein the first tubular collar is configured to engage with an upper portion of the first post, the second tubular collar is configured to engage with a lower portion of the second post, and the third tubular collar is configured to engage with an upper portion of the second post.

5. The stay of claim 1, wherein the first tubular collar is configured to engage with an upper portion of the first post, the second tubular collar is configured to engage with a lower portion of the second post, and the third tubular collar is configured to engage with an upper portion of the third post.

6. The stay of claim 1, wherein the stay is made from hot-dip galvanised steel tubing.

7. The stay of claim 1, wherein the attachment extension is a socket.

8. The stay of claim 1, wherein the first, second, and third tubular collars have an oblong or obround cross-section.

9. The stay of claim 1, wherein a tilt angle between a longitudinal axis of one of the first, second, or third post and a longitudinal axis of one of the first, second, or third collar measures between approximately 0 degrees and approximately 25 degrees.

10. The stay of claim 1, wherein an interior angle between respective longitudinal axes of the first member and the second member measures between approximately 30 degrees and approximately 50 degrees.

11. The stay of claim 10, wherein the interior angle does not substantially exceed 45 degrees.

12. The stay of claim 1, wherein the first tubular collar and the first member are fixedly coupled.

13. The stay of claim 12, wherein the first tubular collar and the second member are fixedly coupled.

14. The stay of claim 1, wherein the first tubular collar, the second tubular collar, and the third tubular collar are coplanar to direct the tension force in a single plane.

15. The stay of claim 1, wherein the first, second, and third collars define at least one pre-drilled hole configured to: (i) receive a screw, rivet, or bolt to secure the respective collar to the respective post; and/or (ii) secure the plurality of wires or mesh of the wire fence to the respective collar.

16. The stay of claim 1, wherein the stay is configured to direct the tension force through the first and second members to the second post and/or the third post to retain the first post, the second post, and/or the third post in the ground without requiring an anchor or load spreading plate.

17. The stay of claim 1, wherein the first attachment location is a first aperture formed in the attachment extension and is configured to receive a first bolt to separably couple the attachment extension and the first member.

18. A method of installing or supporting a wire fence having a plurality of posts and fence wires, comprising installing the stay of claim 1, wherein the method comprises:

(i) securing the first tubular collar to the first post, securing the second tubular collar to the second post, and securing the third tubular collar to the second or third posts; and (ii) connecting the fence wires to the posts.

* * * * *